United States Patent [19]

Ohno

[11] 4,034,515

[45] July 12, 1977

[54] VERTICAL GRINDER

[76] Inventor: Ietatsu Ohno, 1-2, 1-chome, Kasuya, Setagaya, Tokyo, Japan

[21] Appl. No.: 677,985

[22] Filed: Apr. 19, 1976

[51] Int. Cl.[2] ..... B24B 31/00; B08B 3/00

[52] U.S. Cl. ..... 51/7; 51/19; 134/63; 134/76

[58] Field of Search ..... 51/6, 7, 17, 19, 318; 134/63, 76, 82

[56] References Cited

U.S. PATENT DOCUMENTS

| | | | |
|---|---|---|---|
| 1,733,192 | 10/1929 | Haber | 51/7 X |
| 2,341,197 | 2/1944 | Weiskopf | 51/7 |
| 2,921,413 | 1/1960 | Kay | 51/7 |
| 3,623,278 | 11/1971 | Schwartz | 51/7 X |

FOREIGN PATENT DOCUMENTS

| | | | |
|---|---|---|---|
| 204,171 | 10/1967 | U.S.S.R. | 51/7 |

*Primary Examiner*—Gary L. Smith
*Attorney, Agent, or Firm*—Laurence R. Brown

[57] ABSTRACT

A vertical grinder wherein at least two rotating grinding tanks are provided on a horizontally movable bed body, vertically movable and rotatable rotary tanks containing grinding materials respectively for coarse, medium and lustrous finishes are arranged in parallel with them, a vertically movable main spindle is provided above one of said rotary tanks and a plurality of collect chucks are made rotatable and are suspended with a work fitted on the peripheral edge of the lower end surface of said main spindle and are inserted in turn into said rotary tanks respectively for coarse, medium and lustrous finishes to grind the work.

5 Claims, 3 Drawing Figures

VERTICAL GRINDER

This invention relates to vertical grinders and more particularly to a grinder wherein proper amounts of granular chip media or other grinding materials are contained in rotary tanks, a work is suspended by collet chucks provided on a main spindle, the grinding materials in the rotary tank are brought into contact with the work on all the surface while rotating the collet chucks in this state and are made to flow under a pressure to grind the work.

In an already known rotary barrel grinder, generally many works, grinding material and others are contained in a barrel tank and are made to flow by rotating the barrel so that the works may be ground by the mutual friction of the works and grinding materials. Therefore, there have been such defects that particularly, in the case of lustrously finishing the works, if a granular grinding material for a lustrous finish is used for the grinding material from the first, a long time will be required until the finish and that, in the case of requiring such three steps as coarse, medium and lustrous finishes, the respective grinding materials must be replaced in turn in the grinding much to the trouble. There has been also a great defect that hitting dusts will be deposited on the works by the contact of many works with one another during the grinding.

An object of the present invention is to provide a grinder wherein such conventional defects are eliminated and the grinding materials in the barrel tank need not be replaced.

Figure 1:
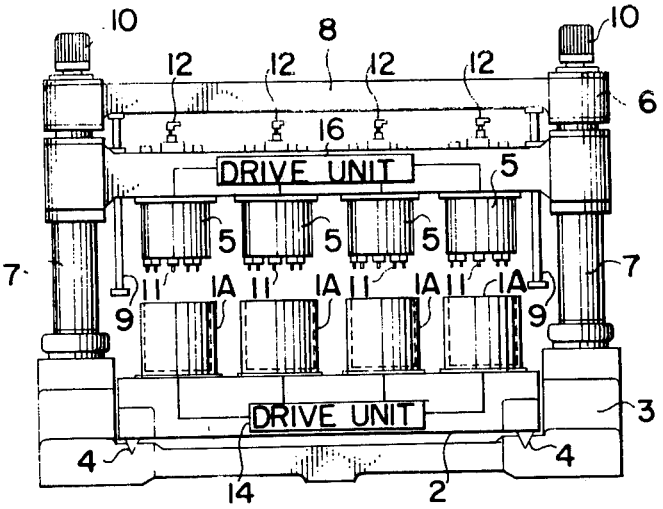
FIG. 1 is an elevation of a vertical grinder embodying the present invention.
Figure 2:
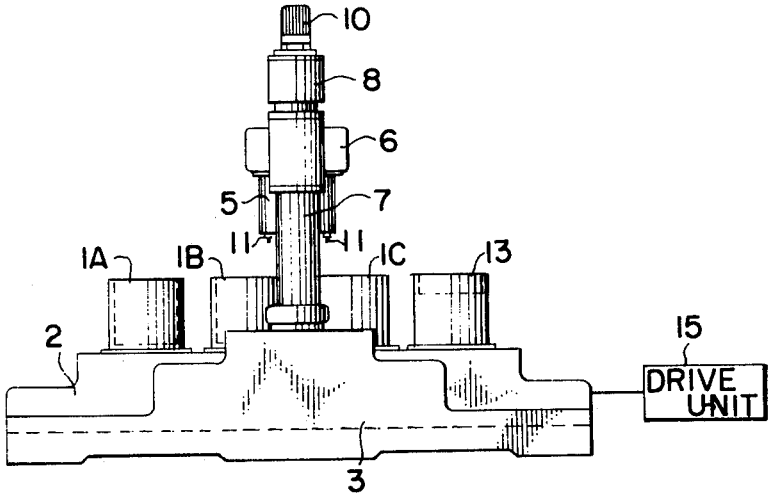
FIG. 2 is a side view of FIG. 1.
Figure 3:
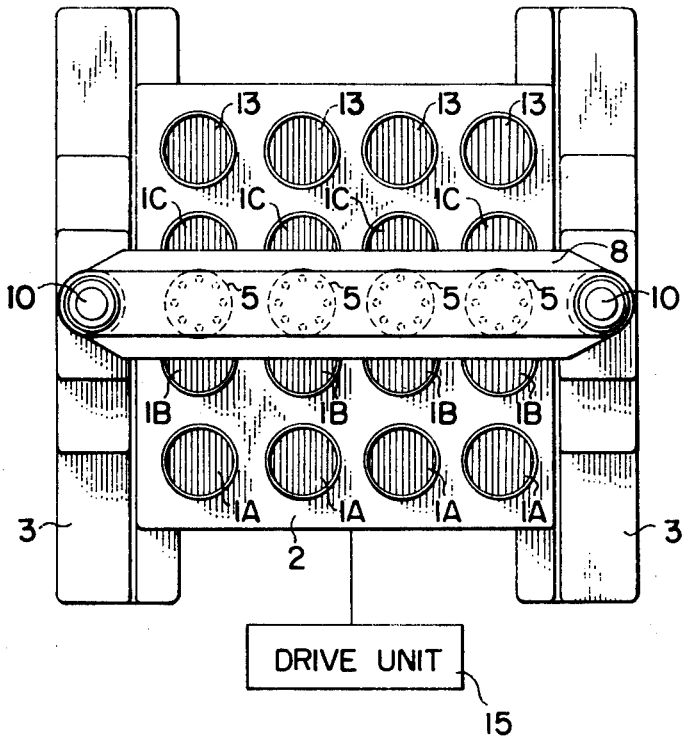
FIG. 3 is a plan view of FIG. 1.

Cylindrical rotary tanks 1A, 1B and 1C contain grinding materials (not illustrated) respectively for coarse, medium and lustrous finishes and are arranged in parallel in turn on a bed body 2 and in the moving direction of the bed body 2. In the drawings, four of each of the rotary tanks 1A, 1B and 1C are arranged in a line and are rotated at a proper velocity by a drive unit 14 provided in the bed body 2. Further, the body bed 2 is moved forward and rearward in FIG. 1 on grooves 4 provided in a body frame 3 by a drive unit 15. On the other hand, a main spindle 5 (four spindles in the drawings) is fitted to a movable column 6 as opposed to and above one of said rotary tanks 1A, 1B and 1C. The movable column 6 moves vertically with the rotation of bar screws 9 provided on an arch frame 8 as guided by supporting columns 7 erected on the body frame 3. By the way, the numeral 19 indicates a motor for driving the column 6. A proper number of collet chucks 11 are fitted to the peripheral edge of the lower end surface of the main spindle 5 so as to be rotatable normally and reversely by a drive unit 16 to suspend a work by a vacuum attraction or mechanical operation. The numeral 12 indicates an air piping therefore. The numeral 13 indicates a setting service station arranged as requied in parallel with the rotary tanks 1A, 1B and 1C on the bed body 2 so as to be used to set the work.

In the above mentioned embodiment, first of all, the bed body 2 is moved to oppose the main spindle 5 onto the setting service station 13 and the main spindle 5 is moved downward to have the work on the service station 13 attracted by the collet chucks 11 and is again moved upward. Next, the bed body 2 is moved to oppose the rotary tank 1A for the coarse finish to the main spindle 5 and then the main spindle 5 is moved downward to insert the work into the rotary tank 1A.

Then, if the collet chucks attracting the work and, as required, the rotary tank 1A are rotated, the grinding material for the coarse finish contained in the rotary tank 1A will also rotate and therefore the work attracted by the collet chucks 11 will be ground on all the surface by the flow of the grinding material under a pressure. Needless to say, the grinding efficiency and the finished state are different depending on the rotating velocity of the collet chucks and rotary tank, the kind of the grinding material and the rotating velocity and direction of the work but the work is ground very easily at a high efficiency. In the same manner, the work attracted by the chucks is inserted in turn into the rotary tanks 1B and 1C respectively for the medium finish and lustrous finish so as to be medium finish-ground and lustrous finish-ground.

As explained above, according to the grinder of the present invention, the work is free to be inserted into the rotary tank from above, can be moved in turn into the rotary tanks respectively for the coarse, medium and lustrous finishes and is ground on all the surface by the flow of the grinding material under a pressure by the rotation, therefore the grinding efficiency is very high, the rotation of the rotary tank can be freely controlled depending on the kinds of the work and grinding material and the grinding can be very effectively automated.

What is claimed is:

1. A vertical grinder comprising a bed body movable in the horizontal direction, a plurality of grinding tanks containing respectively different kinds of grinding materials and arranged in parallel on said bed body, a vertically movable main spindle provided above the grinding tanks and at least one collet chuck rotatably provided on the lower end surface of said main spindle so as to fit a work.

2. The grinder according to claim 1 wherein said grinding tanks are rotatable by a drive unit provided in said bed body.

3. The grinder according to claim 1 wherein said bed body has a body frame having grooves for moving the bed body and having a pair of supporting columns erected at both ends and said main spindle is fitted to a movable column guided by said supporting columns.

4. The grinder according to claim 1 wherein said collet chucks suspend a work by a vacuum attraction.

5. The grinder according to claim 1 wherein a container of a work is set at a setting service station arranged in parallel with said grinding tank on said body bed.

* * * * *